US009647320B2

(12) United States Patent
Lin

(10) Patent No.: US 9,647,320 B2
(45) Date of Patent: May 9, 2017

(54) ANTENNA ASSEMBLY AND ELECTRONIC DEVICE USING THE ANTENNA ASSEMBLY

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 226 days.

(21) Appl. No.: 14/023,692

(22) Filed: Sep. 11, 2013

(65) Prior Publication Data

US 2014/0292584 A1 Oct. 2, 2014

(30) Foreign Application Priority Data

Apr. 2, 2013 (TW) ..... 102111899 A

(51) Int. Cl.
*H01Q 1/24* (2006.01)
*H01Q 9/30* (2006.01)
*H01Q 21/00* (2006.01)

(52) U.S. Cl.
CPC ..... *H01Q 1/243* (2013.01); *H01Q 9/30* (2013.01); *H01Q 21/00* (2013.01)

(58) Field of Classification Search
CPC H01Q 1/42; H01Q 1/243; H01Q 9/30; H01Q 21/00
USPC ..... 343/700
See application file for complete search history.

(56) References Cited

U.S. PATENT DOCUMENTS

| | | | | |
|---|---|---|---|---|
| 7,602,341 | B2 * | 10/2009 | Wei-Shan | H01Q 1/2258 343/700 MS |
| 2005/0128151 | A1 * | 6/2005 | Kwak | H01Q 1/243 343/702 |
| 2011/0136447 | A1 * | 6/2011 | Pascolini | H01Q 1/243 455/90.2 |
| 2011/0248895 | A1 * | 10/2011 | Bungo | H01Q 1/243 343/702 |

* cited by examiner

*Primary Examiner* — Dameon E Levi
*Assistant Examiner* — Walter Davis
(74) *Attorney, Agent, or Firm* — Steven Reiss

(57) ABSTRACT

An antenna assembly includes a first antenna, a second antenna, and a metal member. The second antenna is separate and spaced from the first antenna. A gap is defined on the metal member to divide the metal member into a first frame assembly and a second frame assembly. The first antenna is connected to the first frame assembly, the second antenna is connected to the second frame assembly, and the first antenna is electronically coupled to the second antenna.

20 Claims, 4 Drawing Sheets

ANTENNA ASSEMBLY AND ELECTRONIC DEVICE USING THE ANTENNA ASSEMBLY

BACKGROUND

1. Technical Field

The present disclosure relates to antenna assemblies, especially to an antenna assembly coupled with metal housing and an electronic device using the antenna assembly.

2. Description of Related Art

Electronic devices having metal housings are popular for being strong and having high heat dissipation properties with added attractive appearance. However, metal housings are prone to interfere with wireless signals to or from antennas.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
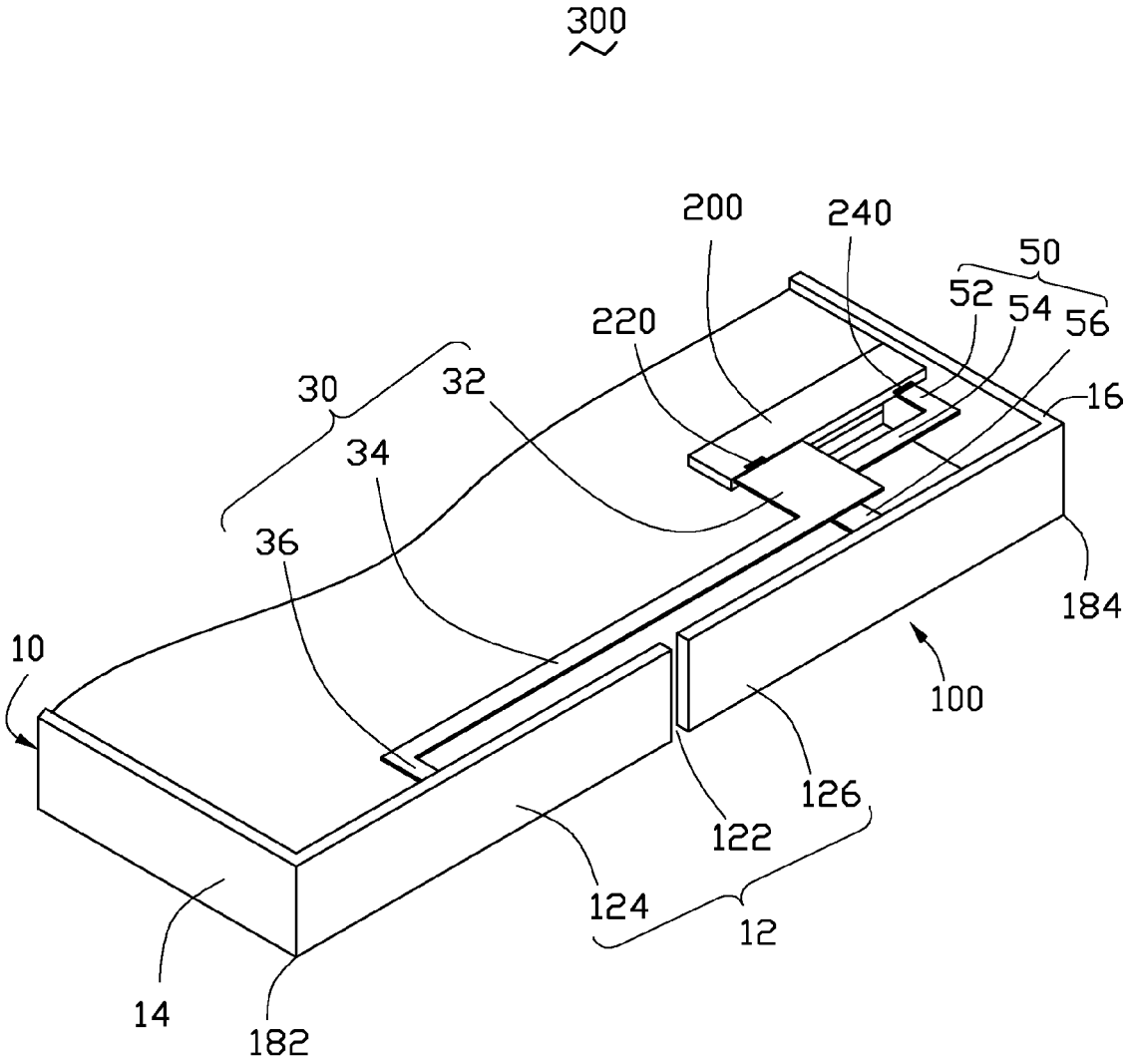
FIG. 1 is an isometric view of an electronic device including an antenna assembly, according to an exemplary embodiment.
Figure 2:
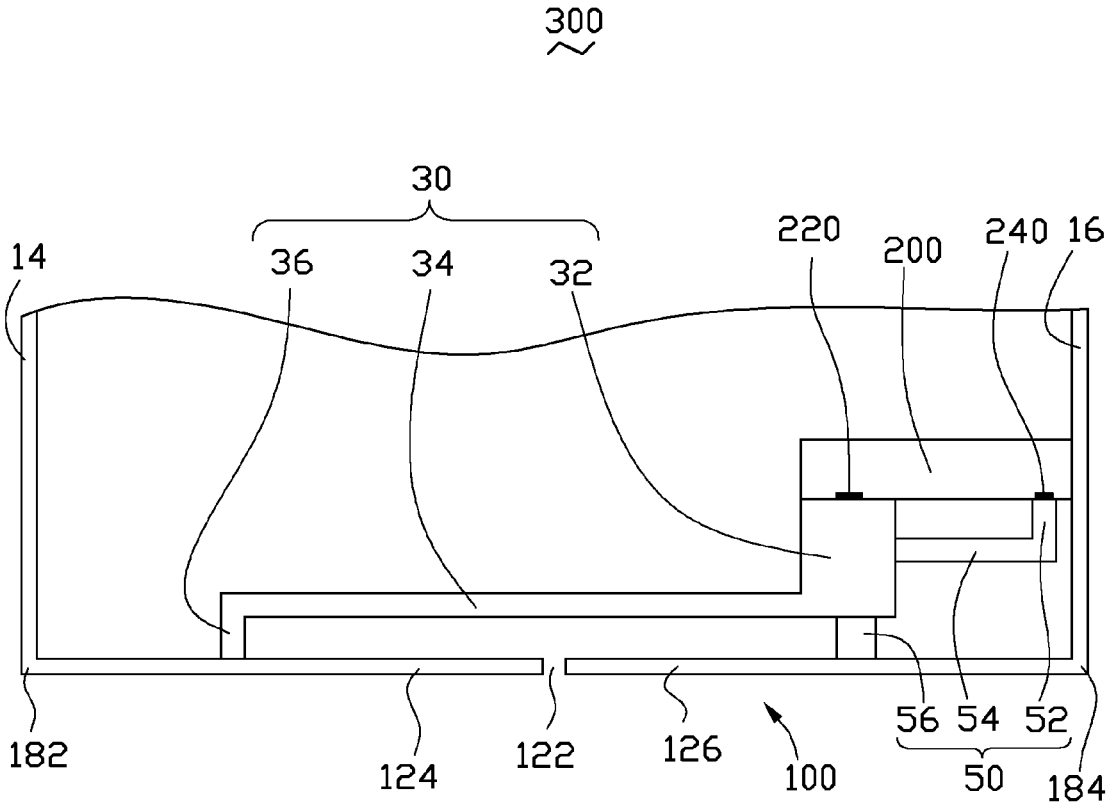
FIG. 2 is a schematic view of the electronic device shown in FIG. 1.

FIGS. 1-2 show an electronic device 300 including an antenna assembly 100, according to an exemplary embodiment. The electronic device 300 may be a mobile phone or a personal digital assistant, for example.

The electronic device 300 further includes a printed circuit board (PCB) 200, and a feed pin 220 and a ground pin 240 are disposed on the PCB 200. The feed pin 220 is configured to provide current to the antenna assembly 100, and the ground pin 240 grounds the antenna assembly 100.

The antenna assembly 100 includes a metal member 10, a first antenna 30, and a second antenna 50. Both of the first antenna 30 and the second antenna 50 are connected to the metal member 10.

The metal member 10 can be a part of the metal housing of the electronic device 300. In one embodiment, the metal member 10 includes a first frame 12, a second frame 14, and a third frame 16. The second frame 14 and the third frame 16 are respectively positioned at two opposite ends of the first frame 12, and are fixed to the PCB 200 by screws (not shown) for electronically connecting to the ground pin 240. A gap 122 is defined at a substantially middle position of the first frame 12 to divide the first frame 12 into a first portion 124 and a second portion 126. The first portion 124 is connected to the second frame 14, to jointly form a first frame assembly 182. The second portion 126 is connected to the third frame 16, to jointly form a second frame assembly 184.

In an exemplary embodiment, the first antenna 30 is a monopole, and includes a coupling section 32, an extending section 34, and a connecting section 36. The coupling section 32 is connected to the feed pin 220 to receive current. The extending section 34 is perpendicularly connected between the coupling section 32 and the connecting section 36. The coupling section 32 and the connecting section 36 are positioned parallel to each other and extend along two opposite directions. In an exemplary embodiment, a width of the coupling section 32 is greater than a width of the extending section 34 and a width of the connecting section 36. The connecting section 36 is connected to the first portion 124 of the first frame 12 by an elastic sheet or other known processes.

In an exemplary embodiment, the second antenna 50 is a strip, and includes a first radiating section 52, a second radiating section 54, and a third radiating section 56. The first radiating section 52 is connected to the ground pin 240. The second radiating section 54 is perpendicularly connected between the first radiating section 52 and the third radiating section 56, the first radiating section 52 and the third radiating section 56 are positioned parallel to each other and extend along two opposite directions. The third radiating section 56 is connected to the second portion 126 of the first frame 12 through an elastic sheet or other known processes.

When the first antenna 30 and the second antenna 50 are mounted in the electronic device 300, the second antenna 50 is separate and spaced from the coupling section 32 of the first antenna 30. For example, the second antenna 50 is located below the coupling section 32, and a space between the second antenna 50 and the coupling section 32 is less than a threshold space such that, the current can be coupled from the coupling section 32 to the second antenna 50. In addition, a space between the second antenna 50 and the first antenna 30 can be configured to receive other elements of the electronic device, such as a flexible printed circuit (FPC), for example.

When current is input to the antenna assembly 100 via the feed pin 220, the first antenna 30 receives the current. The current flows from the first antenna 30 to the first portion 124 and the second frame 14, and then is grounded by the ground pin 240. Thus, a first current path is established, the first antenna 30 and the first frame assembly 182 are activated for jointly receiving and transmitting wireless signals having a first central frequency of about 1600 MHz.

Additionally, the current is coupled from the coupling section 32 to the second antenna 50, the current flows from the second antenna 50 to the second portion 126 and the third frame 16, and then is grounded. Thus, a second current path is established, the second antenna 50 and the second frame assembly 184 are activated for jointly receiving and transmitting wireless signals having a second central frequency of about 2000 MHz.

Figure 3:
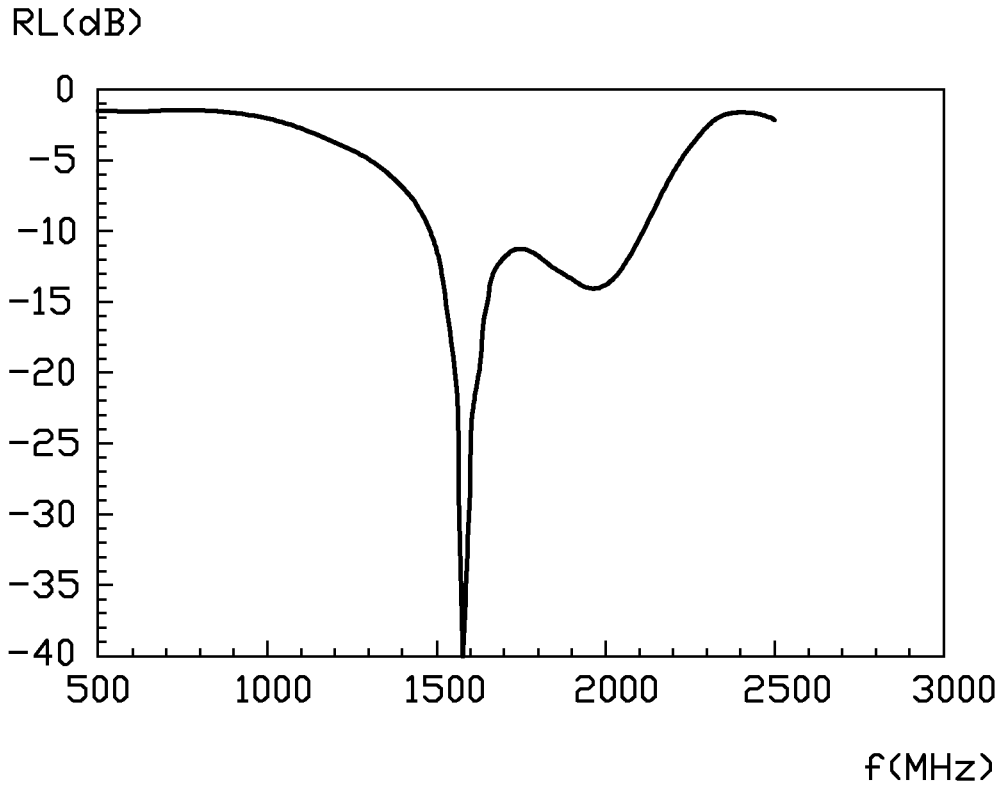
FIG. 3 is a return loss (RL) graph of the antenna assembly shown in FIG. 1.
Figure 4:
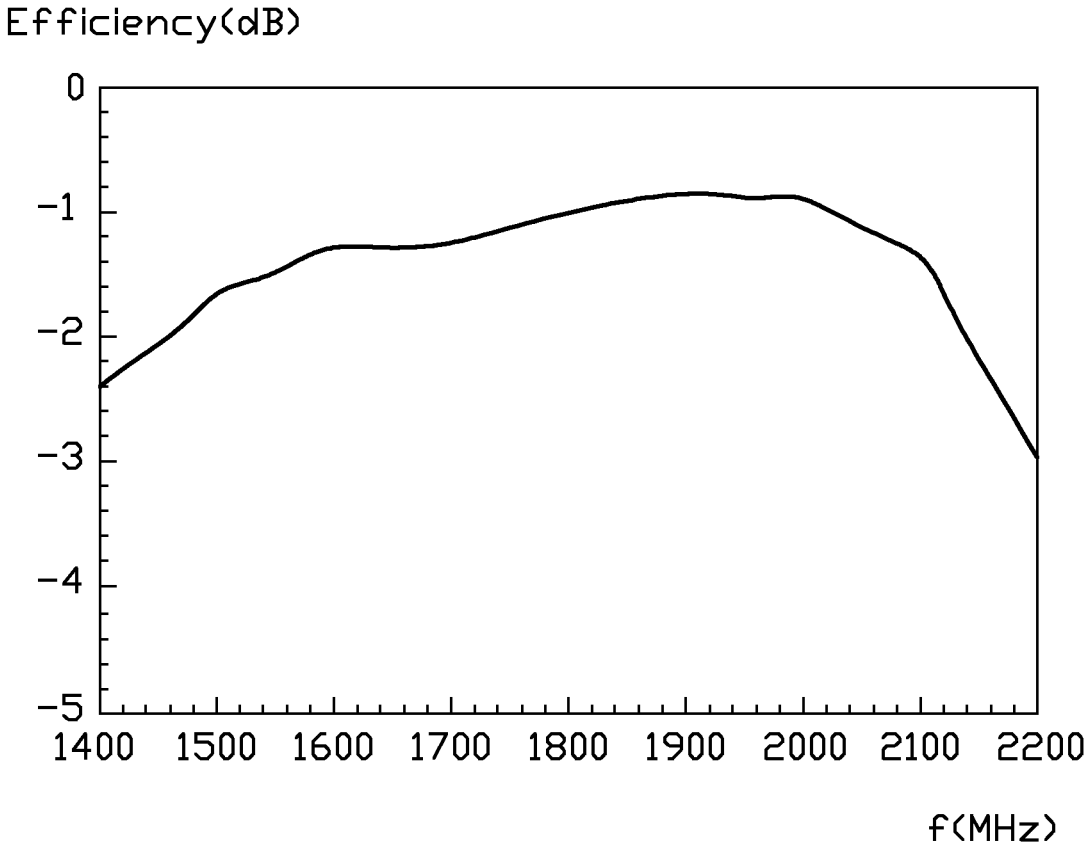
FIG. 4 is an efficiency graph of the antenna assembly shown in FIG. 1.

FIG. 3 is a return loss (RL) graph of the antenna assembly 100 of FIG. 1, and FIG. 4 is an efficiency graph of the antenna assembly 100 of FIG. 1. The antenna assembly 100 has good performance when operating at central frequencies of about 1600 MHz and 2000 MHz.

Additionally, the central frequencies of the antenna assembly 100 can be changed by adjusting a position of the gap 122. For example, when the gap 122 is defined adjacent to the third frame 16, a length of the first current path is increased, and the first central frequency is decreased. A length of the second current path is reduced correspondingly, and the second central frequency is increased.

In summary, the antenna assembly 100 can adapt to a structure of the metal member 10, that is, the structure of the metal member 10 does not require to be changed to suit the antenna assembly 100, thus reducing the cost of the electronic device 300. Additionally, the current on the first antenna 30 can be coupled to the second antenna 50. Therefore, the antenna assembly 100 is small in size and has good communication quality at a plurality of frequency bands used in wireless communications, which allows further size reductions of the electronic device 300 employing the antenna assembly 100.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna assembly, comprising:

a first antenna;

a second antenna separate and spaced from the first antenna; and a metal member comprising a first frame and a second frame connected to the first frame, wherein a gap is defined on the first frame to divide the first frame into a first portion and a second portion;

wherein the first antenna is positioned at a first plane, and the second antenna is positioned at a second plane, the second plane is different from and parallel to the first plane;

wherein the first antenna comprises a coupling section, an extending section, and a connecting section, the coupling section receives current, and the current is coupled from the coupling section to the second antenna, and wherein the extending section is connected between the coupling section and the connecting section, and the coupling section and the connecting section extend along two opposite directions;

wherein the second antenna comprises a first radiating section, a second radiating section, and a third radiating section, the second radiating section is connected between the first radiating section and the third radiating section, the first radiating section and the third radiating section extend along two opposite directions, and a junction of the second radiating section and the third radiating section is located below the coupling section of the first antenna; and wherein the coupling section of the first antenna is configured to be connected to a feed pin of a printed circuit board (PCB) for receiving the current, and the connecting section of the first antenna is connected to the first portion; and wherein the first radiating section of the second antenna is configured to be connected to a ground pin of the PCB for being grounded, and the third radiating section of the second antenna is connected to the second portion;

wherein the connecting section is connected to the first portion, the first antenna, a portion of the first portion, the second portion, a portion of the second frame, and a portion of the PCB cooperatively define a first slot with the gap together.

2. The antenna assembly as claimed in claim 1, wherein the coupling section and the connecting section are positioned parallel to each other, and a width of the coupling section is greater than a width of the extending section and a width of the connecting section.

3. The antenna assembly as claimed in claim 2, wherein the second antenna is located below the coupling section of the first antenna.

4. The antenna assembly as claimed in claim 3, wherein the first radiating section and the third radiating section are positioned parallel to each other.

5. The antenna assembly as claimed in claim 1, wherein the metal member further comprises a third frame, the second frame and the third frame are respectively positioned at two opposite ends of the first frame.

6. The antenna assembly as claimed in claim 5, wherein the first portion is connected to the second frame, and the second portion is connected to the third frame.

7. An electronic device, comprising:

a metal housing having a metal member, wherein the metal member comprises a first frame and a second frame connected to the first frame, and a gap is defined on the first frame to divide the first frame into a first portion and a second portion;

a printed circuit board (PCB) having a feed pin and a ground pin; and an antenna assembly, comprising:

a first antenna electronically connected to the feed pin; and a second antenna separate and spaced from the first antenna, and electronically connected to the ground pin;

wherein the first antenna is positioned at a first plane, and the second antenna is positioned at a second plane, the second plane is different from and parallel to the first plane;

wherein the first antenna comprises a coupling section, an extending section, and a connecting section, the coupling section receives current, and the current is coupled from the coupling section to the second antenna, and wherein the extending section is connected between the coupling section and the connecting section, and the coupling section and the connecting section extend along two opposite directions;

wherein the second antenna comprises a first radiating section, a second radiating section, and a third radiating section, the second radiating section is connected between the first radiating section and the third radiating section, the first radiating section and the third radiating section extend along two opposite directions, and a junction of the second radiating section and the third radiating section is located below the coupling section of the first antenna; and wherein the coupling section of the first antenna is configured to be connected to the feed pin for receiving the current, and the connecting section is connected to the first portion; and wherein the first radiating section is configured to be connected to the ground pin for being grounded, and the third radiating section is connected to the second portion;

wherein the connecting section is connected to the first portion, the first antenna, a portion of the first portion, the second portion, a portion of the second frame, and a portion of the PCB cooperatively define a first slot with the gap together.

8. The electronic device as claimed in claim 7, wherein the coupling section and the connecting section are positioned parallel to each other, and a width of the coupling section is greater than a width of the extending section and a width of the connecting section.

9. The electronic device as claimed in claim 8, wherein the second antenna is located below the coupling section of the first antenna.

10. The electronic device as claimed in claim 9, wherein the first radiating section and the third radiating section are positioned parallel to each other.

11. The electronic device as claimed in claim 7, wherein the metal member further comprises a third frame, the second frame and the third frame are respectively positioned at two opposite ends of the first frame.

12. The electronic device as claimed in claim 11, wherein the first portion is connected to the second frame, and the second portion is connected to the third frame.

13. An antenna assembly, comprising:

a first antenna;

a second antenna separate and spaced from the first antenna; and a metal member comprising a first frame and a second frame connected to the first frame, the first frame having a first portion and a second portion;

wherein the first antenna is connected to the first portion to cooperatively receive/transmit wireless signals having a first central frequency, the second antenna is electronically coupled to the first antenna and is connected to the second portion to cooperatively receive/transmit wireless signals having a second central frequency;

wherein the first antenna comprises a coupling section, an extending section, and a connecting section, the coupling section receives current, and the current is coupled from the coupling section to the second antenna; and wherein the second antenna comprises a first radiating section, a second radiating section, and a third radiating section, the second radiating section is connected between the first radiating section and the third radiating section, and a junction of the second radiating section and the third radiating section is located below the coupling section of the first antenna; and wherein the coupling section of the first antenna is configured to be connected to a feed pin of a printed circuit board (PCB) for receiving the current, and the connecting section is connected to the first portion; and wherein the first radiating section is configured to be connected to a ground pin of the PCB for being grounded, and the third radiating section is connected to the second portion;

wherein the connecting section is connected to the first portion, the first antenna, a portion of the first portion, the second portion, a portion of the second frame, and a portion of the PCB cooperatively define a first slot with the gap together.

14. The antenna assembly as claimed in claim 13, wherein the metal member comprises a first frame, a gap is defined on the first frame to divide the first frame into the first portion and the second portion.

15. The antenna assembly as claimed in claim 14, wherein the metal member further comprises a third frame, the second frame and the third frame are respectively positioned at two opposite ends of the first frame.

16. The antenna assembly as claimed in claim 15, wherein the first portion is connected to the second frame, and the second portion is connected to the third frame.

17. The antenna assembly as claimed in claim 1, wherein the first antenna and the first portion are activated by a first current path, for jointly receiving and transmitting wireless signals having a first central frequency; the second antenna and the second portion are activated by a second current path for jointly receiving and transmitting wireless signals having a second central frequency.

18. The electronic device as claimed in claim 7, wherein the first antenna and the first portion are activated by a first current path, for jointly receiving and transmitting wireless signals having a first central frequency; the second antenna and the second portion are activated by a second current path for jointly receiving and transmitting wireless signals having a second central frequency.

19. The antenna assembly as claimed in claim 1, wherein the third radiating section is connected to the second portion, the second antenna, a portion of the second portion, the second frame, and a portion of the PCB cooperatively define a second enclosed slot together.

20. The electronic device as claimed in claim 7, wherein the third radiating section is connected to the second portion, the second antenna, a portion of the second portion, the second frame, and a portion of the PCB cooperatively define a second enclosed slot together.

* * * * *